US009989205B2

(12) United States Patent
Ogg et al.

(10) Patent No.: US 9,989,205 B2
(45) Date of Patent: Jun. 5, 2018

(54) WALL GRAZER LIGHT FIXTURE

(71) Applicant: Hubbell Incorporated, Shelton, CT (US)

(72) Inventors: Jeremy W. Ogg, Rockland, MA (US); Cory A. Passerello, Plymouth, MA (US)

(73) Assignee: HUBBELL INCORPORATED, Shelton, CT (US)

( * ) Notice: Subject to any disclaimer, the term of this patent is extended or adjusted under 35 U.S.C. 154(b) by 189 days.

(21) Appl. No.: 15/177,503

(22) Filed: Jun. 9, 2016

(65) Prior Publication Data

US 2016/0363277 A1 Dec. 15, 2016

Related U.S. Application Data

(60) Provisional application No. 62/172,899, filed on Jun. 9, 2015.

(51) Int. Cl.

| | |
|---|---|
| ***F21V 1/00*** | (2006.01) |
| ***F21S 8/02*** | (2006.01) |
| ***F21S 8/00*** | (2006.01) |
| ***F21V 21/02*** | (2006.01) |
| ***F21V 21/04*** | (2006.01) |
| ***F21V 23/00*** | (2015.01) |
| *F21V 7/00* | (2006.01) |
| *F21Y 115/10* | (2016.01) |

(52) U.S. Cl.

CPC ..... *F21S 8/026* (2013.01); *F21S 8/036* (2013.01); *F21V 21/02* (2013.01); *F21V 21/04* (2013.01); *F21V 23/00* (2013.01); *F21V 7/0008* (2013.01); *F21Y 2115/10* (2016.08)

(58) Field of Classification Search

CPC ... F21S 8/026; F21S 8/03; F21S 8/036; F21V 21/02; F21V 21/34; F21V 23/00; F21V 7/0008; F21Y 2115/10

See application file for complete search history.

(56) References Cited

U.S. PATENT DOCUMENTS 4,725,931 A * 2/1988 Bourdon ..... F21V 7/0008 362/147
4,748,543 A * 5/1988 Swarens ..... F21S 8/02 362/147

(Continued)

OTHER PUBLICATIONS

PCT International Search Report for corresponding PCT application No. PCT/US2016/036670, dated Sep. 8, 2016, 2 pages.

(Continued)

*Primary Examiner* — Ali Alavi

(74) *Attorney, Agent, or Firm* — Dority & Manning, P.A.

(57) ABSTRACT

Wall grazer light fixtures that are configured to illuminate portions of walls are provided. In one embodiment, a wall grazer light fixture can include one or more first light sources for providing wide angle illumination along a wall. In addition, the wall grazer light fixture can include one or more second light sources arranged in the wall grazer light fixture to provide vertical illumination along the wall. In some embodiments, the wall grazer light fixture can include a circuit configured to adjust a color temperature of the first light source(s) and/or the second light source(s) such that the color temperature of the first light source(s) matches the color temperature of the second light source(s).

20 Claims, 6 Drawing Sheets

(56) References Cited

U.S. PATENT DOCUMENTS

| | | | |
|---|---|---|---|
| D329,299 | S | 9/1992 | Cole, Jr. |
| 5,160,193 | A | 11/1992 | Fabbri et al. |
| 8,277,071 | B2 | 10/2012 | Anglikowski et al. |
| 2005/0259416 | A1 | 11/2005 | Gauna et al. |
| 2006/0109650 | A1 | 5/2006 | Hunerbein et al. |
| 2010/0182786 | A1 | 7/2010 | Hein |
| 2011/0187270 | A1 | 8/2011 | Summerford et al. |
| 2012/0326613 | A1 | 12/2012 | Liu |
| 2015/0098218 | A1 | 4/2015 | Kai et al. |

OTHER PUBLICATIONS

Litecontrol, "Wall/Slot-2000," Plympton, MA, www.litecontrol.com, Sep. 12, 2013—5 pages.

Litecontrol, "Wall/Slot-6000," Plympton, MA, www.litecontrol.com, May 26, 2015—3 pages.

PCT International Preliminary Report on Patentability for corresponding PCT application No. PCT/US2016/036670, dated Dec. 12, 2017, 8 pages.

* cited by examiner

WALL GRAZER LIGHT FIXTURE

PRIORITY CLAIM

The present application claims priority to U.S. Provisional Patent Application Ser. No. 62/172,899, entitled "Wall Grazer Light Fixture," filed Jun. 9, 2015, which is incorporated herein by reference.

FIELD

The present disclosure relates generally to light fixtures, and more particularly to wall grazer light fixtures.

BACKGROUND

Light fixtures can be installed to illuminate portions of walls for aesthetic purposes and/or to illuminate objects located on the walls. For instance, wall grazer light fixtures can be arranged to illuminate a wall from a location sufficiently close to the wall to highlight and accentuate wall textures and other features. In some instances, wall grazer light fixtures can be installed so as to be concealed from view and to illuminate the wall with light at the junction of a ceiling and the wall.

Certain wall grazer light fixtures use incandescent lamps to provide light along a vertical length of a wall illuminated by the fixture. However, the use of incandescent lamps in this manner can result in top-of-the-wall shadowing. Fluorescent lamps can provide for wide angle illumination at the top of the wall with reduced shadows. However, the use of fluorescent lamps with wall grazer light fixtures may not provide sufficient vertical illumination along a vertical length of the wall.

Light emitting diode (LED) devices are becoming increasingly used in many lighting applications and have been integrated into a variety of products, such as light fixtures, indicator lights, flashlights, and other products. LED lighting systems can provide increased energy efficiency, life and durability, can produce less heat, and can provide other advantages relative to traditional incandescent and fluorescent lighting systems. Moreover, the efficiency of LED lighting systems has increased such that higher power can be provided at lower cost to the consumer.

LED devices can be associated with certain correlated color temperatures. The color temperature of an LED device provides a measure of the color of light emitted by the LED device. For instance, the color temperature can refer to the temperature of an ideal black body radiator that radiates light of comparable hue to the LED device. LED devices associated with higher color temperatures (e.g. 5000 K) can provide a cooler color temperature (e.g. bluish color) while LED devices associated with lower color temperatures (e.g. 2500 K to 3000 K) can provide a warmer color temperature (e.g. reddish or amber color).

SUMMARY

Aspects and advantages of embodiments of the present disclosure will be set forth in part in the following description, or may be learned from the description, or may be learned through practice of the embodiments.

One example aspect of the present disclosure is directed to a wall grazer light fixture. The light fixture includes a fixture body having a reflector portion and a platform configured to support one or more first light sources. The light fixture includes an arm extending from the fixture body at a location above the reflector portion. The arm has an aperture facing a downward direction. The wall grazer light fixture is configured to receive one or more first light sources configured to provide wide angle illumination and to receive one or more second light sources configured to provide narrow angle illumination. The wide angle illumination provides a wider angle of illumination relative to the narrow angle illumination.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
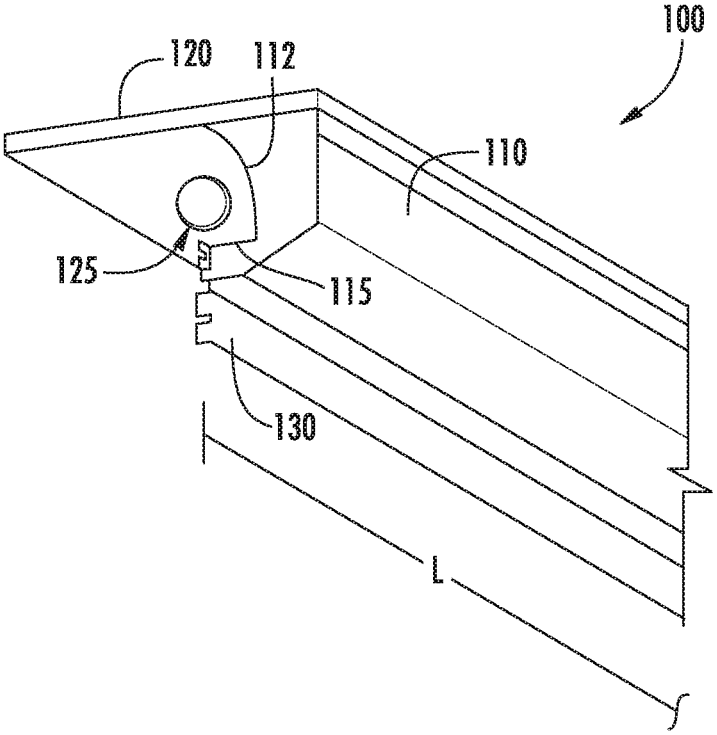
FIG. 1 depicts a perspective view of a portion of an example wall grazer light fixture according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to wall grazer light fixtures that are configured to illuminate portions of walls. In one embodiment, a wall grazer light fixture can include one or more first light source(s) for providing wide angle illumination along a wall. In addition, the wall grazer light fixture can include one or more second light sources arranged in the wall grazer light fixture to provide vertical illumination along the wall. In this way, the wall grazer light fixture can provide for the enhanced illumination of a wall by providing a mix of both vertical and high angle fill lighting with reduced shadowing, such as top-of-the-wall shadowing.

More particularly, a wall grazer light fixture can include a fixture body. The fixture body can have a reflector portion extending between a first end and a second end of the fixture body. The fixture body can further include a platform extending from the first end. A ceiling support channel can be used to secure the first end of the fixture body to a ceiling. The platform can support one or more first light sources, such as one or more first light emitting diode (LED) devices. The one or more first light sources can be arranged such that the reflector portion reflects light output provided by the first light sources to provide wide angle illumination of a wall. In some embodiments, wide angle illumination or wide angle light can refer to light having an angle of illumination where a majority of the light extends to within about 20° or greater relative to vertical axis, such as about 30° or greater, such as about 40° or greater, such as about 45° or greater, such as about 50°, such as about 60° or greater, such as about 70° or greater, such as about 90° or greater.

An arm can extend from the second end of the reflector portion and can be configured to be secured to a wall (e.g. using a support rail). The arm can include one or more apertures facing in a generally downward direction. A second light source (e.g. a point light source such as a second LED device) can be disposed relative to each of the one or more apertures so that each second light source provides vertical illumination along the wall.

In some embodiments, the second light sources can have a color temperature that matches a color temperature associated with the first light sources. As used herein, a color temperature of a first light source "matches" a color temperature of a second light source when a difference between the color temperature of the first light source and the second light source is not noticeable when observed under normal operating conditions. In one implementation, the second light source can have a color temperature that is specifically selected to match the color temperature of the one or more first light sources. In another implementation, the wall grazer light fixture can include a circuit configured to adjust a color temperature of the first and/or second light sources such that the color temperature of the first light source(s) matches the color temperature of the second light source(s).

With reference now to the Figures, example embodiments of the present disclosure will now be set forth. FIG. 1 depicts a perspective view of a portion of an example wall grazer light fixture 100 according to example embodiments of the present disclosure. As will be discussed in detail below, the wall grazer light fixture 100 can secured to a wall at a location close to the junction of a ceiling and the wall and can be concealed at least in part by the ceiling. The wall grazer light fixture 100 can be configured to provide lighting along a wall to highlight and accentuate wall textures and other features.

A portion of the wall grazer light fixture 100 is depicted in FIG. 1 for ease of illustration. The wall grazer light fixture 100 can have any suitable length L depending on the desired application and installation of the wall grazer light fixture 100. For instance, in some example embodiments, the wall grazer light fixture can have a length of about 2 ft, 3 ft, 4 ft, 6 ft, 8 ft, or other suitable length. As used herein, the use of the term "about" in conjunction with a numerical value is intended to refer to within 40% of the stated numerical value.

The wall grazer light fixture 100 includes a fixture body 110 having a concave reflector portion 112 and a platform 115 extending from the concave reflector portion 112. The reflector portion 112 and/or platform 115 can be integral with or otherwise attached or secured to the portions of the fixture body 110. The platform 115 can be configured to support or to receive one or more first light source(s), such as one more first LED devices or other suitable light sources (e.g. fluorescent light sources and incandescent sources). The first light source(s) can be arranged relative to reflector 112 to provide wide angle illumination. The wall grazer light fixture 100 can be secured to a portion of a ceiling using a ceiling support channel 130 and can be secured to a portion of a wall using an arm 120 extending from the fixture body 110.

As demonstrated in FIG. 1, the wall grazer light fixture 100 can further include an aperture 125 defined in the arm 120 extending from the fixture body 110. The aperture 125 can face in a generally downward direction. The aperture 125 can receive a second light source for providing vertical illumination along a vertical length of a wall. The second light source can be a point light source, such as an LED lamp or other LED device, or other suitable light source.

Figure 2:
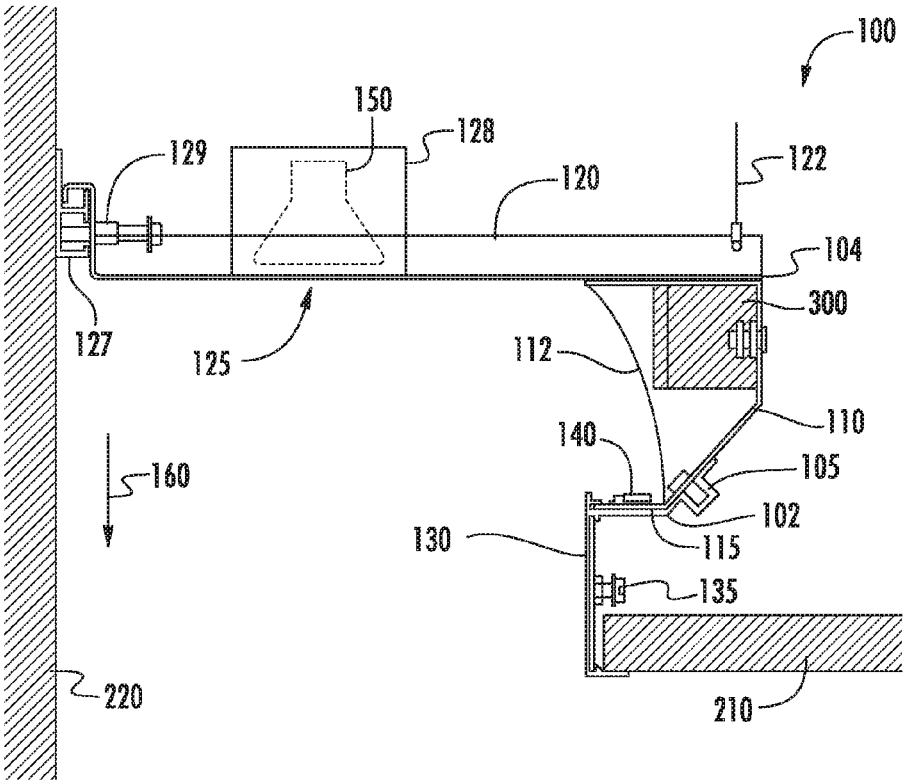
FIG. 2 depicts a profile view of an example wall grazer light fixture according to example embodiments of the present disclosure.

FIG. 2 depicts a profile view of the example wall grazer light fixture 100 installed relative to a ceiling 210 and wall 220. The wall grazer light fixture 100 includes a fixture body 110 having a reflector portion 112 extending between a first end 102 and a second end 104 of the fixture body 110. The fixture body 110 can further include a platform 115 extending from the first end 102. The reflector portion 112 and/or the platform 115 can be integral with or otherwise secured to or forming a part of the fixture body 110. The fixture body 110 can be formed from any suitable material. In one example, the fixture body 110 is made at least in part from die-formed steel.

The reflector portion 112 can be configured to reflect light from one or more first light sources 140 supported by platform 115 in a downward direction 160 along wall 220. In some embodiments, the reflector portion 112 is shaped for wide angle illumination of the wall with maximum downward light projection. In some embodiments, the reflector portion 112 can be made from die-formed steel. The reflector portion 112 can be finished in high-reflectance white for uniform light distribution. In some embodiments, the reflector portion 112 can be die-formed specular hammertone aluminum or other suitable material. In some embodiments, the reflector portion 112 can include a parabolic reflector portion or other suitable shape to provide a desired optical distribution of light reflected by the reflector portion 112. Other shapes of the reflector portion 112 are contemplated, such as convex, linear, or other suitable shapes.

The wall grazer light fixture 110 includes an arm 120 extending from the fixture body 100 in a direction toward the wall 220. The arm 120 can be integral with the fixture body 110 or can be attached to the fixture body 110 using a suitable attachment mechanism (e.g. bolts, hooks, etc.). Similar to the fixture body, the arm 120 can be made from die-formed steel. In some embodiments, the arm 120 can be finished in high-reflectance white.

The wall grazer light fixture 110 can be secured to the wall 220 by securing the arm 120 to a fixture support rail 127. The fixture support rail 127 can provide continuous support and alignment of the wall grazer light fixture 110 along the wall 220. The fixture support rail 127 can include one or more grooves, lips, or other features for engaging the arm 120 to secure the arm to the wall 220. The fixture support rail 127 can be secured to the wall 220 using screws, bolts, nails, or other attachment mechanisms (e.g. attachment mechanism 129). The fixture support rail 127 can be made from any suitable material, such as extruded aluminum.

The arm 120 can further be configured to receive support attachments 122 (e.g. support chains) for suspending the fixture 100. The support attachments 122 can be spaced along the length of the fixture 100, such as every 2 ft, every 1.5 ft, or other suitable spacing. The support attachments 122 can be secured to a support structure for suspending the fixture 100.

Figure 3:
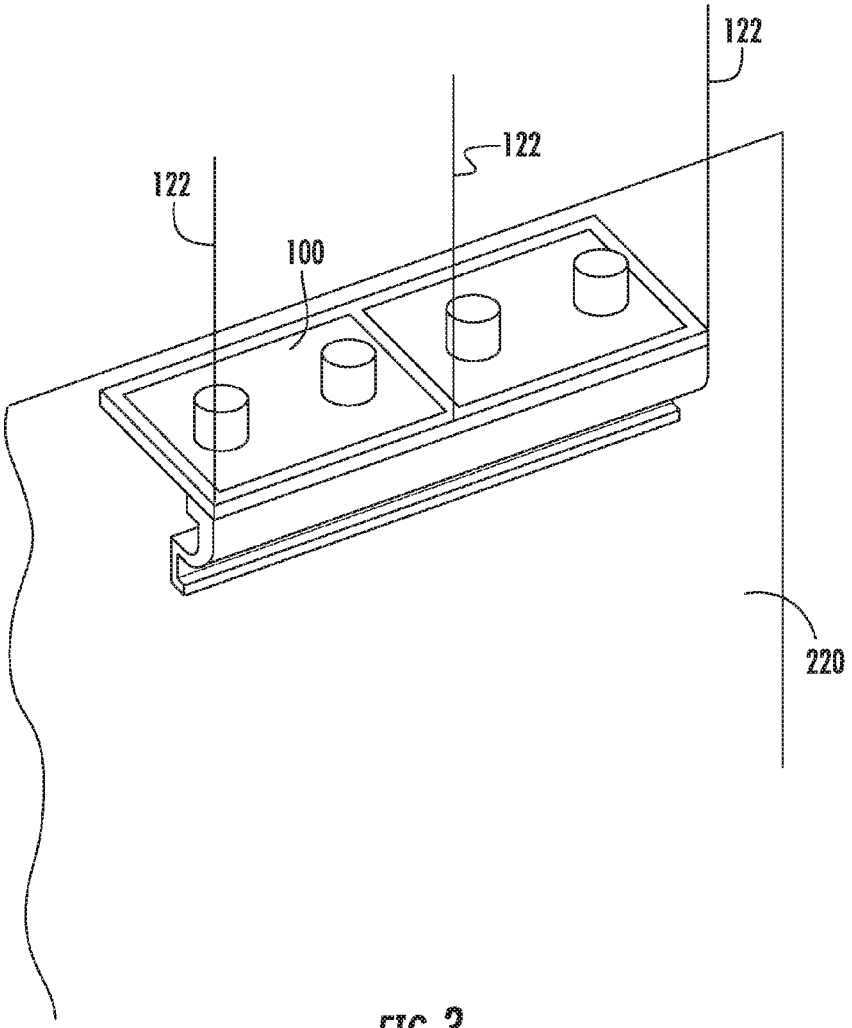
FIG. 3 depicts a perspective view of an example wall grazer light fixture secured to a wall according to example embodiments of the present disclosure.

FIG. 3 depicts a perspective view of the example fixture 100 secured to wall 220 and suspended using support attachments 122.

Referring to FIG. 2, the fixture 100 can further include a ceiling support channel 130. The ceiling support channel 130 can be integral with or otherwise a part of or secured to the fixture body 110 (e.g. via attachment mechanisms 105, 135, etc.). The ceiling support channel 130 can be configured to receive or engage a portion of a ceiling 210, such as a ceiling tile of a drop down grid ceiling. In this way, at least a portion of the fixture body 110 can be concealed from view by observers looking upwards toward the ceiling 210 at the junction of the ceiling 210 and the wall 220.

Referring still to FIG. 2, the wall grazer light fixture 100 can receive one or more first light sources 140 supported on platform 110. The one or more first light sources 140 can be LED devices that are configured to emit light as a result of electrons moving through as semiconductor material. In particular, implementations, the one or more first light sources 140 can include an LED board having a plurality of LED devices associated with different color temperatures. This can allow for the control of color temperature output of the first light source(s) 140 as will be discussed in more detail below. While the present subject matter is discussed with reference to the first light source(s) 140 including one or more LED devices, those of ordinary skill in the art, using the disclosures provided herein, will understand that the first light source(s) 140 can be other types of light sources, such as fluorescent light sources or incandescent lights, without deviating from the scope of the present disclosure, with each combination providing its own benefits.

As demonstrated in FIG. 2, the arm 120 of the fixture 100 includes one or more apertures 125 along the length of the fixture 100. For instance, the arm 120 of the fixture 100 can include one, two, three, four, six, or other suitable number of apertures 125 spaced along the length of the arm 120. Each aperture 125 can face a generally downward direction 160 when the fixture 100 is installed adjacent to a wall 200 as illustrated in FIG. 2. As used herein, a generally downward direction refers to with about 75° of the downward direction 160 extending parallel with the wall 220.

The aperture 125 can be interfaced with a housing 128 which can receive a second light source 150. The second light source 150 can be positioned relative to the aperture 125 to provide illumination in a generally downward direction along at least a portion of a vertical length of the wall 220. The second light source 150 can be a point light source, such as an LED lamp. In one particular implementation, the second light source 150 can be an MR16 LED lamp. However, other suitable point light sources can be used as a second light source 150 without deviating from the scope of the present disclosure, such as an incandescent light source (e.g. a halogen lamp).

In some embodiments, the fixture 100 can include reflectors, lenses, and/or other optics in conjunction with the apertures 125 to provide a desired light distribution from the second light source(s) 150. For example, the fixture 100 can include a lens disposed over aperture, such as a glass, polycarbonate, acrylic, or silicone lens or other suitable lens The second light source(s) 150 can be associated with a particular color temperature. In particular embodiments, the second light source(s) 150 can be selected to have a color temperature that matches a color temperature associated with the first light source(s) 140. For instance, a manufacture or other provider of the fixture 100 can provide information that suggests particular second light source(s) 150 for use with fixture 100 so that the color temperature of the second light source(s) 150 matches or is otherwise suitable for use with the color temperature of the first light source(s) 140. In other embodiments, as will be discussed in further detail below, the fixture 100 can include control circuitry for adjusting the color temperature of the first light source(s) 140 and/or the second light source(s) 150 so that the color temperature of the second light source(s) 150 matches or is otherwise suitable for use with the color temperature of the first light source(s) 140.

Figure 4:
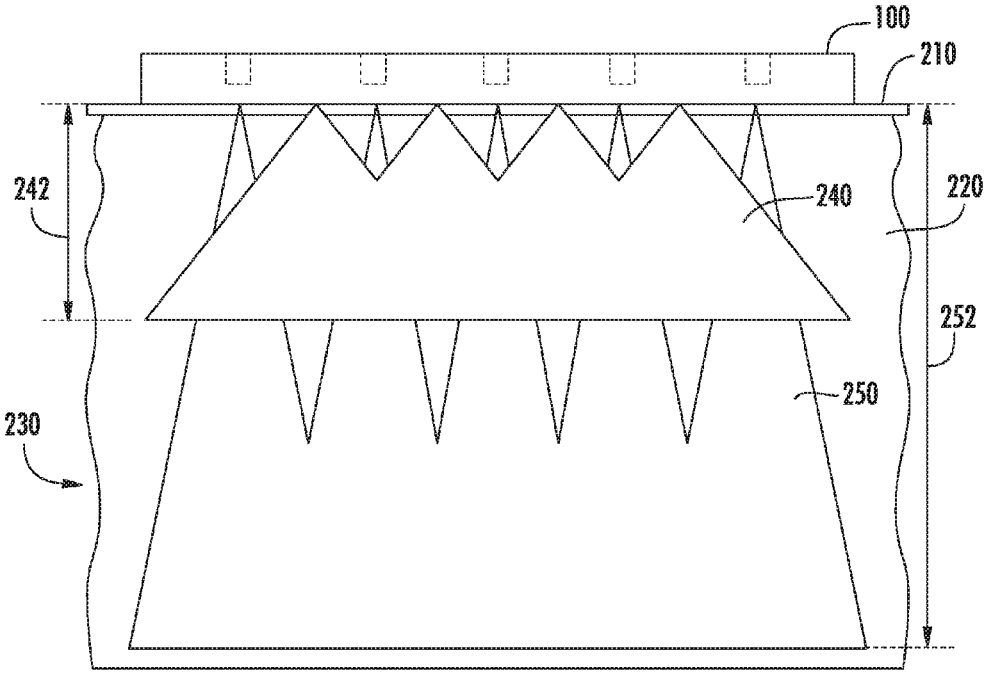
FIG. 4 depicts a front view of an example light pattern provided along a wall by an example wall grazer light fixture according to example embodiments of the present disclosure.

FIG. 4 depicts an example light pattern 230 provided along a wall 220 by the wall grazer light fixture 100 according to example embodiments of the present disclosure. As shown, the wall grazer light fixture 100 can provide wide angle light 240 from first light source(s) 140 (shown in FIG. 2). The wide angle light 240 can extend a first vertical distance 242 along a vertical length of the wall 220.

The wall grazer light fixture 100 can further provide vertical light 250 along wall 220 from second light source(s) 150 (shown in FIG. 2). The vertical light 250 extends a second vertical distance 252 down a vertical length of the wall 220. As shown in FIG. 4, the second vertical distance 252 is greater than the first vertical distance 242. The wide angle light 240 can span a horizontal distance at a location near the top of the wall that is wider than the vertical light 250. In this way, the wall grazer light fixture 100 according to example embodiments of the present disclosure can provide a light pattern 230 that extends a greater distance along a vertical length of a wall 220 with reduced top-of-the-wall shadowing. This can provide for enhance light grazing of the wall 220 for highlighting and accentuating wall textures and other features.

Referring back FIG. 2, the fixture body 110 can house control devices and circuitry 300 for powering and controlling the first light source(s) 140 and second light source(s) 150. The circuitry 300 can include, for instance, one or more driver circuits for providing a driver current to power the first light source(s) 140 and/or the second light source(s) 150. The one or more driver circuits can be configured to receive an input power, such as an input AC power or an input DC power, and can convert the input power to a suitable driver current for powering the first light source(s) 140 and/or the second light source(s) 150.

In some embodiments, the one or more driver circuits can include various components, such as switching elements (e.g. transistors) that are controlled to provide a suitable driver current. For instance, in one embodiment, the driver circuit can include one or more transistors. Gate timing commands can be provided to the one or more transistors to convert the input power to a suitable driver current using pulse width modulation techniques. In other instances, the one or more driver circuits may be direct drive AC circuits with full bridge rectification.

In some example embodiments, the one or more driver circuits can be dimmable driver circuits. For instance, the one or more dimmable driver circuits be a line dimming driver, such as a phase-cut dimmable driver, Triac dimmer, trailing edge dimmer, or other line dimming driver. The driver current can be adjusted using the line dimming driver(s) by controlling the input power to the dimmable driver circuit(s). In addition and/or in the alternative, the dimmable driver circuit(s) can receive a dimming control signal used to control the driver current. The dimming control signal can be provided from an external circuit, such as an external dimming circuit or sensor (e.g. an optical sensor, thermal sensor, or other sensor configured to provide feedback to the driver circuit for use by the driver circuit to adjust the driver current). The external circuit can include one or more devices, such as a manual dimmer, smart dimming interface, a potentiometer, a Zener diode, or other device. The dimming control signal can be a 0V to 10V control signal or can be implemented using other suitable protocols, such as a DALI protocol, or a DMX protocol.

In some embodiments, the circuitry 300 can include, for instance, control devices to adjust the color temperature of the first light source(s) 140 and/or the second light source(s) 150 so that the color temperature of the first light source(s) 140 matches a color temperature of the second light source(s) 150. Example circuitry for powering and controlling the first light source(s) 140 and second light source(s) 150 are disclosed in U.S. Provisional Patent Application Ser. No. 62/147,917, assigned to Hubbell Incorporated and U.S. patent application Ser. No. 14/667,203, assigned to Hubbell Incorporated, both of which are incorporated by reference in their entirety herein for all purposes.

In some embodiments, the first light source(s) 140 can include two or more light channels or arrays. Each light channel or array can include one or more LED devices having a different color temperature. A circuit can be used to control a current supplied to the various light channels or arrays to adjust the color temperature output of the first light source(s) 140 to match a color temperature of the second light source(s) 150.

In some embodiments, a closed loop system can be used to adjust the color temperature output of the first light source(s) 140 to match a color temperature output of the second light source(s) 150. For instance, an optical sensor can be used to monitor the light output of the first light source(s) 140 and the second light source(s) 150. The optical sensor can be an ambient color sensor, light sensor, or other device configured to monitor light output and/or color of the light emitted by the LED arrays 132 and 134 and/or the lighting system 106. The optical sensor can provide a feedback signal to the control circuit which can adjust the light output of the first light source(s) 140 and/or the second light source(s) 150 so that the color temperature of the first light source(s) 140 matches the color temperature of the second light source(s) 150.

Aspects of the present disclosure will be discussed with reference to adjusting the color temperature of the first light source(s) 140 to match the color temperature of the second light source(s) 150 for purposes of illustration and discussion. Those of ordinary skill in the art, using the disclosures provided herein, will understand that the color temperature of the second light source(s) 150 can be adjusted to match the color temperature of the first light source(s) 140 without deviating from the scope of the present disclosure.

In one embodiment, a dim-to-warm circuit can be used to control the color temperature of the first light source(s) 140. The dim-to-warm circuit can operate to change the color temperature of the light output of the first light source(s) 140 based on the dimming of the driver current provided to the first light source(s) 140.

Figure 5:
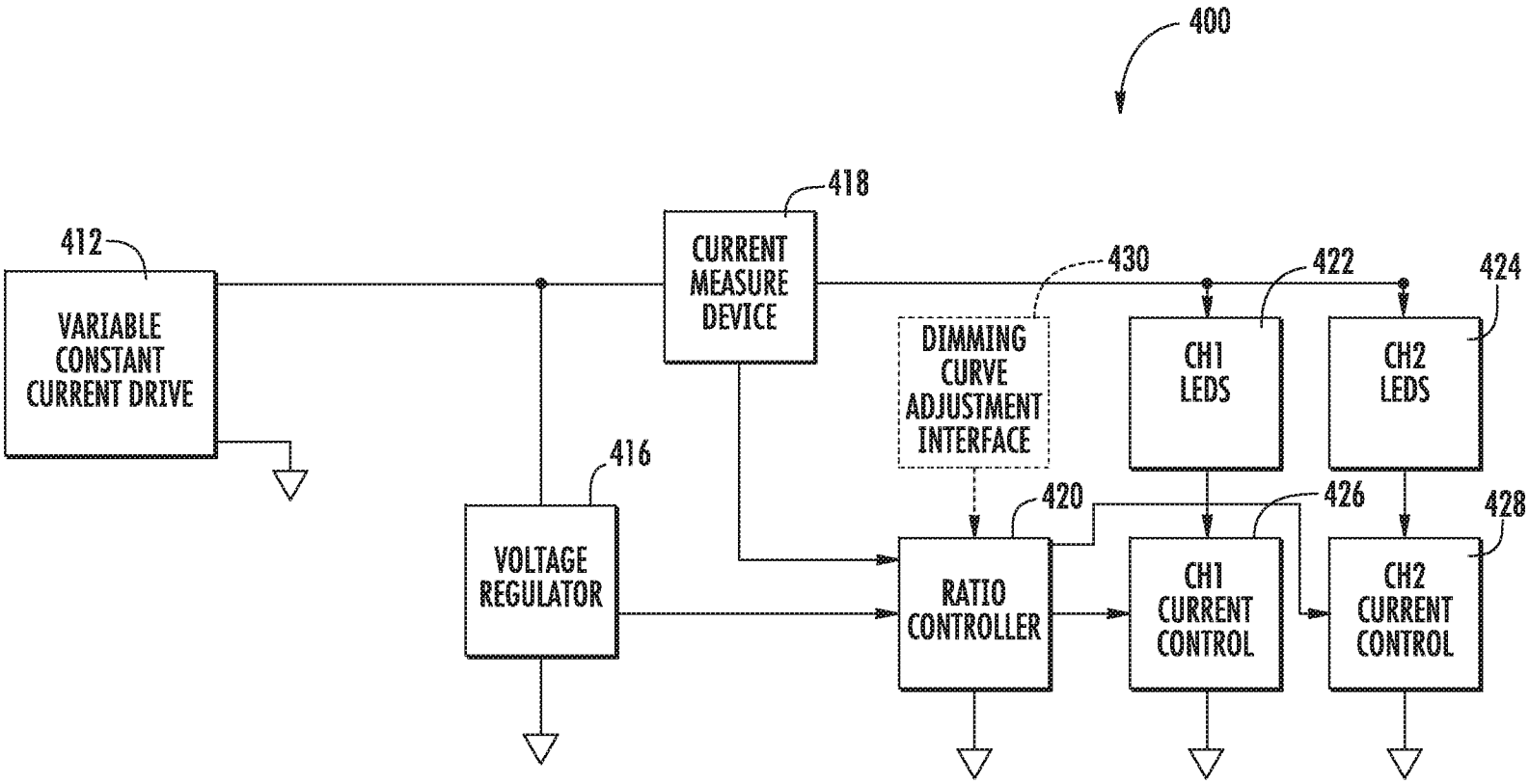
FIG. 5 depicts a block diagram of an example circuit for powering and controlling one or more light sources used in an example wall grazer light fixture according to example embodiments of the present disclosure.

FIG. 5 depicts a block diagram of an example dim-to-warm circuit 400 used to control the color temperature of the first light source(s) 140 according to example embodiments of the present disclosure. The dim-to-warm circuit 400 can receive a current input from a variable constant current drive 412 (e.g. a driver circuit). The variable constant current drive 412 can output a direct current (DC). A dimming switch or other dimming adjustment device or mechanism can vary the magnitude of the DC current from about a 10% value to about 100% or maximum current output. The dimming adjustment device can be operated manually to adjust the DC current output. In some embodiments, a separate on/off switch disconnects power to the current drive 412.

A voltage regulator 416 can receive the input current from the current drive 412. A current measure device 418 can receive and measure the current output from the current drive 412 and can output a measured current value.

A controller 420, such as a ratio controller, can receive inputs from the voltage regulator 416 and the current measure device 418. The controller 420 can include one or more control devices, and can be a micro-controller, such as a microprocessor including a memory. In another embodiment, an application specific integrated circuit (ASIC) is contemplated. The controller 420 can be configured to process the measured current value and output current values as discussed in detail below.

A first light channel 422 and a second light channel 424 can receive the current output by the current drive 412. The first light channel 422 can be electrically connected in series to a first current control 426 whereby current passes through the first light channel 422 and the first current control 426. The first current control 426 receives a current value output by controller 420. In one embodiment, the first current control 426 is a gated transistor and the current value is provided to the gate.

The second light channel 424 is electrically connected in series to a second current control 428 whereby current passes through the second light channel 424 and the second current control 428. The second current control 428 also receives a current value output by controller 420. In one embodiment, the second current control 428 is a gated transistor and the current value is provided to the gate.

In one embodiment, the first light channel 422 can be a first plurality of LED devices connected in series, and preferably white LED devices having a first correlated color temperature. The second light channel 424 can be a second plurality of LED devices connected in series, which are preferably amber LED devices. The first light channel 422 and the second light channel 424 are provided in parallel as shown in FIG. 5. Other colors including red, green and orange, along with variations of white, are contemplated. The LED devices for the second light channel 424 have a different second correlated color temperature than the LEDs of the first light channel 422.

An optional dimming curve adjustment interface 430 is provided to communicate with the controller 420 to adjust a dimming curve for the combination of light channels that is stored in the controller 420. In one embodiment, the dimming curve adjustment interface 430 is a Bluetooth wireless device for wireless communication with the controller 420. In other embodiments, the dimming curve adjustment interface 430 is a resistor that connects to pins of a processor of the controller 420. Other arrangements are contemplated.

The voltage regulator 416 can receive a small or negligible portion of the current output from the current drive 412. The voltage regulator 416 can output a small voltage to the controller 420 to power the controller 420. The voltage regulator 416 can be configured so that adequate voltage is provided to power the controller 420 even if the current from the current drive is less than 10% of its maximum current value, and even less than 5% or other suitable threshold in some embodiments.

In operation, the constant DC current that is output by the current drive 412 can be adjusted. The current output by the current drive 412 can be input to the first light channel 422 and the second light channel 424. The controller 420 can receive a measured current value obtained by the current measuring device 418. The controller 420 can compare the measured current value to a maximum current value for the current drive 412 to calculate or otherwise determine a light control value. In some embodiments, the light control value can be a percentage light control value from 0% to about 100%.

The controller 420 can determine a ratio of current provided to the first light channel 422 relative to the second light channel 424. More specifically, the controller 420 determines how much of the current output by the current drive is provided to each of the light channels 422, 424.

A memory (not shown) provided with the ratio controller 420 can store proportional current values for each of the light channels 422, 424 that correspond to a given percentage light control value. The controller 420 can use the percentage light control value to obtain a current value or percentage for light to be output by the first light channel 422 and a current value or percentage for light to be output by the second light channel 424. Upon the determination of the current values, the controller 420 sends a first current value for applying a first current to the first current control 426 and a second current value for applying a second current to the second current control 428. Thus, the first current is based on the first current value and the second current is based on the second current value. Changing the values of the first current and the second current result in different desired correlated color temperatures for the light output at different ones of the percentage light control values.

Figure 6:
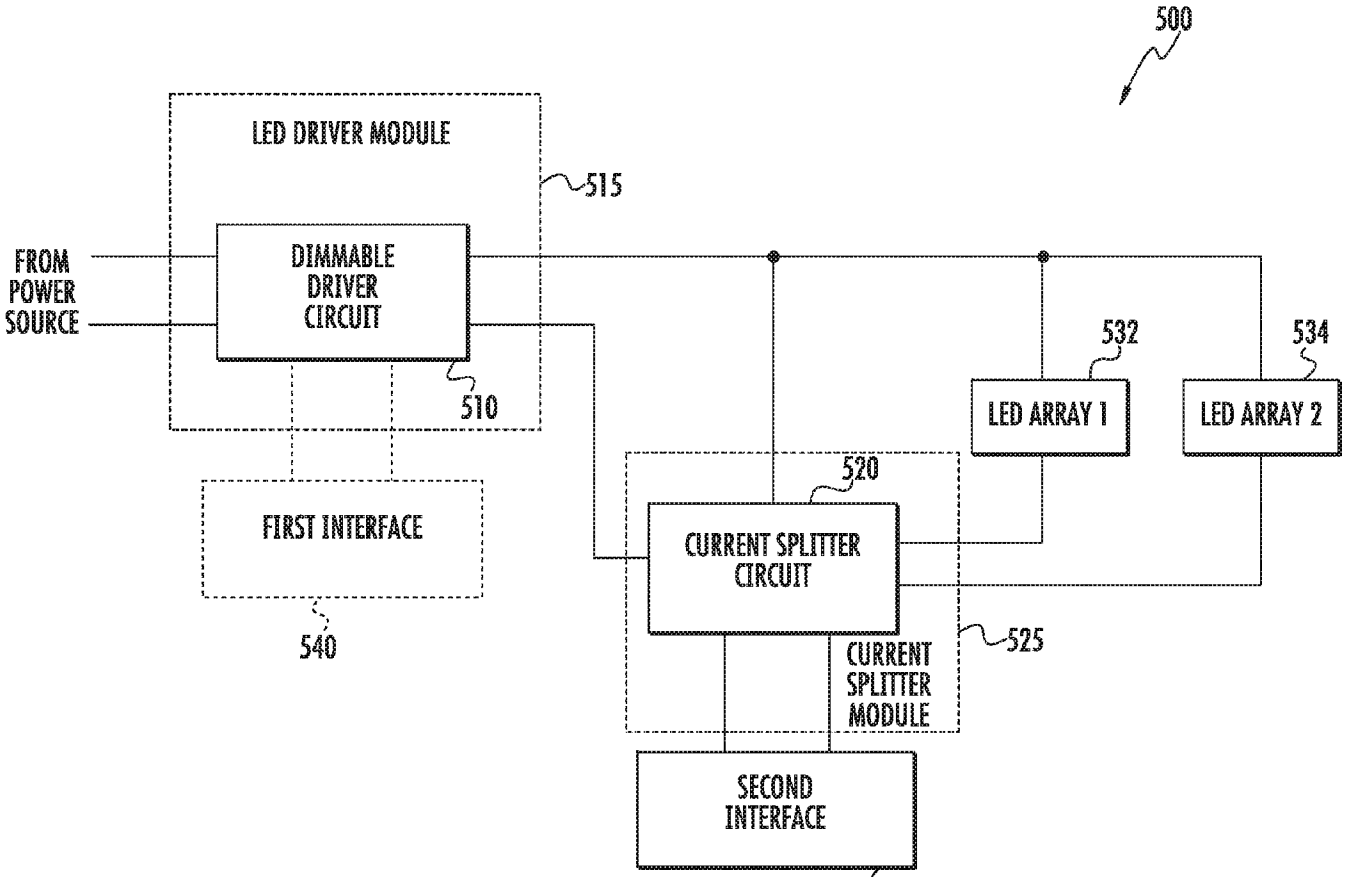
FIG. 6 depicts a block diagram of an example circuit for powering and controlling one or more light sources used in an example wall grazer light fixture according to example embodiments of the present disclosure.

In another embodiment, a current splitter circuit can be used to control the color temperature of the first light source(s) 140. FIG. 6 depicts a block diagram of an example current splitter system 500 used to control the color temperature of the first light source(s) 140 according to example embodiments of the present disclosure.

The current splitter system 500 can include an LED driver module 515, a current splitter module 525, and a plurality of LED arrays (channels), including a first LED array 532 and a second LED 534. While two LED arrays are illustrated in FIG. 6, those of ordinary skill in the art, using the disclosures provided herein, will understand that any number of LED arrays can be used without deviating from the scope of the present disclosure.

Each of the first LED array 532 and the second LED array 534 can include one or more LED devices. The LED devices can emit light (e.g. visible light, ultraviolet light, infrared light, or other light or electromagnetic energy) as a result of electrons moving through a semiconductor material. In particular example implementations, the first LED array 532 can be associated with a different color temperature than the second LED array 534. For instance, the first LED array 532 can include one or more LED devices that emit light at a different color temperature than the second LED array 534.

The LED driver module 515 can include a dimmable driver circuit 510. The current splitter module 525 can include a current splitter circuit 520. In the embodiment illustrated in FIG. 6, the LED driver module 515 can be disposed in a housing, circuit board, or other component that is separate from and/or external to the current splitter module 525. For instance, the current splitter module 525 can be a module external to the LED driver module 515 that is disposed in an electrical path between the LED driver module 515 and the plurality of LED arrays.

The dimmable driver circuit 510 can be configured to receive an input power, such as an input AC power or an input DC power, and can convert the input power to a suitable driver output (e.g. driver current) for powering the plurality of LED arrays. In some embodiments, the dimmable driver circuit 510 can include various components, such as switching elements (e.g. transistors) that are controlled to provide a suitable driver output. For instance, in one embodiment, the driver circuit 510 can include one or more transistors. Gate timing commands can be provided to the one or more transistors to convert the input power to a suitable driver output using pulse width modulation techniques. In some example embodiments, the dimmable driver circuit 510 can be a line dimming driver, such as a phase-cut dimmable driver, Triac dimmer, trailing edge dimmer, or other line dimming driver. The driver output can be adjusted using the line dimming driver by controlling the input power to the dimmable driver circuit.

In addition and/or in the alternative, a first interface 540 can be provided at the dimmable driver circuit 510 for receiving a dimming control signal used to control the driver output. The first interface 540 can include one or more components for communicating the dimming control signal to the driver circuit 510. For example, the first interface 540 can include one or more circuits, terminals, pins, contacts, conductors, or other components for communicating the dimming control signal to the driver circuit 510.

The dimming control signal can be provided from an external circuit, such as an external dimming circuit. The external circuit can include one or more devices, such as a smart dimming interface, a potentiometer, a Zener diode, or other device. In one example implementation, the dimming control signal can be a 0V to 10V dimming control signal, depending on the output of the external circuit. For instance, if a user manually adjusts a dimmer, the dimming control signal can be adjusted from, for instance, 0V to 5V. The dimming control signal can be implemented using other suitable protocols, such as a digital addressable lighting interface (DALI) lighting control signal, digital multiplex (DMX) lighting control signal, or other suitable protocol.

The driver circuit 510 can be configured to adjust the driver output based at least in part on the dimming control signal. For example, reducing the dimming control signal by 50% can result in a corresponding reduction in the driver output of about 50%. The reduction of the driver output can reduce the overall driver current for supply to the plurality of LED arrays. As a result, the light output of the plurality of LED arrays can be simultaneously adjusted (e.g. dimmed) by varying the dimming control signal.

As illustrated in FIG. 6, the driver output can be provided to a current splitter circuit 520. The current splitter circuit 520 can be configured to split the driver output into a first current for powering the first LED array 532 and a second current for powering the second LED array 534. In this way, the current splitter circuit 520 can be used to adjust the light output of the first LED array 532 relative to the light output of the second LED array 534. The current splitter circuit 520 can be configured to control the current ratio of the first current provided to the first LED array 532 to the second current provided to the second LED array based on a variable reference signal (e.g. a 0V to 10V lighting control signal).

More particularly, a second interface 550 at the current splitter circuit 120 can receive variable reference signal. The second interface 550 can include one or more components for communicating the variable reference signal to the current splitter circuit 520. For example, the second interface 550 can include one or more circuits, terminals, pins, contacts, conductors, or other components for communicating a variable reference signal to the current splitter circuit 520.

The variable reference signal can be provided from an external circuit, such as an external dimming circuit. The external circuit can include one or more devices, such as a smart dimming interface, a potentiometer, a Zener diode, or other device. The variable reference signal can be a 0V to 10V lighting control signal, depending on the output of the external circuit. If a user manually adjusts a dimmer, the variable reference signal can be adjusted from, for instance, 0V to 5V. The variable reference signal can be implemented using other suitable protocols, such as a DALI protocol, or a DMX protocol.

The current splitter circuit 520 can include one or more control devices (e.g. a microprocessor, a microcontroller, logic device, etc.) and one or more switching elements (e.g. transistors) in line with each of the first LED array 532 and the second LED array 534. The control device(s) can control the amount of current provided to the first LED array 532 and the second LED array 534 by controlling the switching elements. The switching elements used to control the amount of current provided to the first LED array 532 and to the second LED array 534 can be either on the low voltage side of the LED arrays or the high voltage side of the LED arrays.

In particular aspects, the control device(s) can control the current provided to the first LED array 532 and to the second LED array 534 according to a current ratio control curve based on the variable reference signal. The current ratio control curve can be stored in firmware or stored in a memory accessible by the control device. The current ratio control curve can specify the current ratio of the first current provided to the first LED array 532 and the second current provided to the second LED array 534 as a function of at least the variable reference signal.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A wall grazer light fixture, comprising:

a fixture body having a reflector portion and a platform configured to support one or more first light sources;

an arm extending from the fixture body at a location above the reflector portion, the arm having an aperture facing a downward direction;

wherein the wall grazer light fixture is configured to receive one or more first light sources configured to provide wide angle illumination and to receive one or more second light sources configured to provide narrow angle illumination, the wide angle illumination providing a wider angle of illumination relative to the narrow angle illumination.

2. The wall grazer light fixture of claim 1, wherein the one or more first light sources are arranged relative to the reflector portion to provide illumination of a wall.

3. The wall grazer light fixture of claim 2, wherein the each of the one or more second light sources comprises a point light source.

4. The wall grazer light fixture of claim 3, wherein each of the one or more second light sources is configured to provide vertical illumination of the wall.

5. The wall grazer light fixture of claim 1, wherein the wide angle illumination has an associated angle of illumination such that a majority of light extends to within about 20° or greater relative to vertical axis.

6. The wall grazer light fixture of claim 1, the wide angle illumination has an associated angle of illumination such that a majority of the light extends to within about 30° or greater relative to vertical axis.

7. The wall grazer light fixture of claim 1, wherein the one or more first light sources are each arranged relative to the reflector to provide illumination extending a first distance along a vertical length of wall in a vertical direction from the arm.

8. The wall grazer light fixture of claim 7, wherein the one or more second light sources are each configured to provide illumination extending a second distance in the vertical direction from the arm, the second distance being greater than the first distance.

9. The wall grazer light fixture of claim 1, wherein the one or more first light sources comprise one or more light emitting diode (LED) devices.

10. The wall grazer light fixture of claim 9, wherein the one or more second light sources comprises one or more LED devices.

11. The wall grazer light fixture of claim 1, wherein the one or more second light sources have a color temperature selected to match a color temperature of the one or more first light sources.

12. The wall grazer light fixture of claim 1, further comprising a driver circuit configured to provide a driver current to the one or more first light sources or to the one or more second light source.

13. The wall grazer light fixture of claim 1, further comprising a circuit configured to adjust color temperature of light output by one or more of the first light sources and the second light sources such that a color temperature of the light output by the one or more first light sources matches a color temperature of a light output by the one or more second light sources.

14. The wall grazer light fixture of claim 13, wherein the circuit configured to adjust color temperature comprises a dim-to-warm circuit.

15. The wall grazer light fixture of claim 13, wherein the circuit configured to adjust color temperature comprises a current splitter circuit.

16. A light fixture for illuminating a wall, the light fixture comprising:

a fixture body having a reflector extending between a first end and a second end, the fixture body having a platform extending from the first end;

an arm extending from the second end of the fixture body above the reflector, the arm configured to be secured to a wall, the arm having a plurality of apertures facing a generally downward direction;

a ceiling channel coupled to the fixture body and configured to engage at least a portion of a ceiling;

one or more first light sources arranged on the platform; and one or more second light sources, each of the one or more second light sources disposed in one of the plurality of apertures.

17. The light fixture of claim 16, wherein the one or more first light sources are arranged relative to the reflector to provide first illumination along the wall, the first illumination extending a first distance along the wall in a vertical direction from the arm.

18. The light fixture of claim 17, wherein the plurality of second light sources are configured to provide second illumination along the wall, the second illumination extending a second distance along the wall in the vertical direction from the arm, the second distance being greater than the first distance.

19. The light fixture of claim 17, wherein the fixture body is configured to be at least partially concealed from view by the ceiling when installed.

20. A lighting system, comprising:

a fixture body having a concave reflector extending between a first end and a second end, the fixture body having a platform extending from the first end;

an arm extending from the second end of the fixture body above the concave reflector, the arm configured to be secured to a wall, the arm having a plurality of apertures facing a generally downward direction;

one or more first light emitting diode (LED) devices arranged on the platform so as to provide first illumination along the wall; and one or more second LED devices, each of the one or more second LED devices disposed relative to one of the plurality of apertures so as to provide second illumination along the wall, the second illumination associated with an illumination angle that is narrower than an illumination angle associated with the first illumination.

* * * * *